US012006947B2

(12) United States Patent
Heli et al.

(10) Patent No.: US 12,006,947 B2
(45) Date of Patent: Jun. 11, 2024

(54) DIAGONAL FAN WITH OUTLET GUIDE VANE DEVICE

(71) Applicant: ebm-papst Mulfingen GmbH & Co. KG, Mulfingen (DE)

(72) Inventors: Thomas Heli, Langenburg (DE); Joerg Guenther, Doerzbach (DE); Peter Riegler, Boxberg (DE); Daniel Gebert, Dehringen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/275,574

(22) PCT Filed: Oct. 9, 2019

(86) PCT No.: PCT/EP2019/077415
§ 371 (c)(1),
(2) Date: Mar. 11, 2021

(87) PCT Pub. No.: WO2020/099033
PCT Pub. Date: May 22, 2020

(65) Prior Publication Data

US 2022/0106966 A1 Apr. 7, 2022

(30) Foreign Application Priority Data

Nov. 16, 2018 (DE) ..... 10 2018 128 791.7

(51) Int. Cl.
*F04D 29/38* (2006.01)
*F04D 25/06* (2006.01)
(Continued)

(52) U.S. Cl.
CPC ..... *F04D 29/384* (2013.01); *F04D 25/06* (2013.01); *F04D 29/325* (2013.01); *F04D 29/44* (2013.01); *F04D 29/703* (2013.01)

(58) Field of Classification Search
CPC ..... F04D 25/08; F04D 29/4253; F04D 29/30; F04D 29/288; F04D 29/44; F04D 29/441;
(Continued)

(56) References Cited

U.S. PATENT DOCUMENTS 2,380,772 A * 7/1945 McMahan ..... F04D 29/441 415/199.3
2010/0329871 A1* 12/2010 Cahill ..... F04D 29/626 416/187
(Continued)

FOREIGN PATENT DOCUMENTS

DE 203 19 749 U1 11/2004
DE 20 2010 016 820 U1 3/2012
(Continued)

OTHER PUBLICATIONS

International Search Report and Eng. translation dated Jan. 17, 2020, issued in the corresponding PCT Patent Application No. PCT/EP2019/077415.
(Continued)

*Primary Examiner* — Philip E Stimpert
(74) *Attorney, Agent, or Firm* — Dickinson Wright PLLC

(57) ABSTRACT

A diagonal fan has an electric motor, housing, and diagonal impeller, which is accommodated within the housing, can be driven via the electric motor, and generates a diagonal flow during operation that is deflected in an axial flow direction by an inner wall of the housing. Outlet guide vane device with a plurality of guide vanes distributed in the circumferential direction is arranged adjacently to the diagonal impeller when viewed in the axial flow direction, and homogenizes airflow generated by the diagonal impeller. Guide vanes have a radial extension from a hub region of the outlet guide vane device to the housing. An imaginary extension in the outflow angle of the diagonal impeller strikes the inner wall of the housing at an axial distance K from the diagonal
(Continued)

impeller. Outlet guide vane device is arranged at axial distance H to diagonal impeller where 0.75≤K/H≤1.25.

11 Claims, 4 Drawing Sheets

(51) Int. Cl.
*F04D 29/32* (2006.01)
*F04D 29/44* (2006.01)
*F04D 29/70* (2006.01)

(58) Field of Classification Search
CPC .... F04D 29/181; F04D 28/183; F04D 29/526; F04D 29/183; F04D 29/70; F04D 29/701; F04D 29/703; F04D 29/326
See application file for complete search history.

(56) References Cited

U.S. PATENT DOCUMENTS

| | | | | |
|---|---|---|---|---|
| 2012/0020778 | A1* | 1/2012 | Ruck | F04D 29/281 415/208.1 |
| 2012/0039731 | A1* | 2/2012 | Sadi | F04D 29/164 417/423.7 |
| 2017/0284413 | A1* | 10/2017 | Kim | F04D 17/162 |

FOREIGN PATENT DOCUMENTS

| | | | | |
|---|---|---|---|---|
| DE | 10 2014 210 373 | A1 | 12/2015 | |
| DE | 20 2016 106 538 | U1 | 12/2016 | |
| DE | 20 2016 106538 | U1 | 12/2016 | |
| DE | 202016106538 | U1 * | 1/2017 | F04D 17/04 |
| DE | 20 2012 013 643 | U1 | 11/2018 | |
| EP | 1895166 | A1 | 3/2008 | |
| EP | 2314882 | A1 | 4/2011 | |
| EP | 2410183 | A2 | 1/2012 | |
| EP | 2418388 | A2 | 2/2012 | |
| EP | 2876305 | A1 | 5/2015 | |
| EP | 3 287 707 | A1 | 2/2018 | |
| KR | 101295905 | B1 * | 8/2013 | F04D 29/54 |

OTHER PUBLICATIONS

German Search Report dated Jan. 15, 2020, which issued in the corresponding German Patent Application No. 10 2018 128 791.7.
German Search Report dated May 19, 2023, which issued in the corresponding German Patent Application No. 19 786 761.7.

* cited by examiner

DIAGONAL FAN WITH OUTLET GUIDE VANE DEVICE

BACKGROUND

Field

The disclosure relates to a diagonal fan in a compact axial construction and with simultaneously long air throw distances.

Generally, diagonal fans and the use thereof are known from the prior art, for example from DE 10 2014 210 373 A1.

Description of Related Art

Diagonal fans are used in applications where high demands are placed on the air flow with higher counterpressure and small installation spaces, for example in HVAC technology or with extraction hoods. Due to the large motor diameter of the motor arranged on the central axis as compared to the installation space with diagonal fans, the blow-out surface is relatively small at the blow-out opening, which results in high outlet losses when air flows through at a high dynamic pressure at the outlet of the diagonal fan.

SUMMARY

Typically, axial fans are used for achieving long air throw distances. However, diagonal fans are beneficial for compact construction. The object of example embodiments is to achieve both the aspects of a compact construction with simultaneously long air throw distance and pressure increase.

This object is achieved by the combination of features according to example embodiments wherein a diagonal fan comprises an electric motor, a housing, and a diagonal impeller, which is accommodated within the housing and can be driven via the electric motor, the diagonal flow thereof generated during operation being deflected in an axial flow direction by an inner wall of the housing. An outlet guide vane device with a plurality of guide vanes, which are distributed in the circumferential direction, is arranged adjacently to the diagonal impeller when viewed in the axial flow direction, the outlet guide vane device homogenizing an airflow generated by the diagonal impeller. The guide vanes have a radial extension from a hub region of the outlet guide vane device to the housing, and an imaginary extension in the outflow angle of the diagonal impeller strikes the inner wall of the housing at an axial distance K from the diagonal impeller, and the outlet guide vane device is arranged at an axial distance H to the diagonal impeller such that $0.75 \leqslant K/H \leqslant 1.25$.

In accordance with another aspect of example embodiments, the outlet guide vane device is formed as a single part with the housing In accordance with another aspect of example embodiments, the outlet guide vane device has a protective grille extending over a blow-out portion of the diagonal fan, which protective grille has an axial length L, which is less than an axial length C of the outlet guide vane device, where $L<0.5\times C$. As a further example, outlet guide vane device, the housing, and the protective grille are formed as a single part.

In accordance with another aspect of example embodiments, the protective grille has a plurality of annular webs arranged coaxially as relates to each other, each of which form web surfaces which extend parallel to the axial flow direction and are opposite one another.

In accordance with another aspect of example embodiments, the annular webs are formed to axially protrude in the region of the guide vanes as relates to a leading edge of the respective guide vanes.

In accordance with another aspect of example embodiments, the guide vanes of the outlet guide vane device are curved in the shape of an arc and/or are profiled in the axial cross-section.

In accordance with another aspect of example embodiments, the guide vanes of the outlet guide vane device are formed to curve three-dimensionally.

In accordance with another aspect of example embodiments, the guide vanes of the outlet guide vane device directly merge into the protective grille.

In accordance with another aspect of example embodiments, a maximum diameter G of the hub region of the outlet guide vane device is greater than a maximum diameter F of a hub of the diagonal impeller such that the hub region of the outlet guide vane device covers the hub of the diagonal impeller, as viewed in an axial projection.

In accordance with another aspect of example embodiments, the outlet guide vane device has a motor mount for the electric motor in the hub region.

In accordance with another aspect of example embodiments, the diagonal impeller has a slinger ring, which encloses the impeller blades distributed in the circumferential direction.

In accordance with another aspect of example embodiments, that the slinger ring establishes the outflow angle of the diagonal impeller.

In accordance with another aspect of example embodiments, the electric motor is formed as an external rotor motor.

In accordance with another aspect of example embodiments, the diagonal fan further comprises an inlet nozzle, which is arranged on the housing on the intake side, and wherein the inlet nozzle extends into the slinger ring in the axial direction.

BRIEF DESCRIPTION OF THE DRAWINGS

Other advantageous further embodiments of the invention are characterized in the dependent claims and/or are shown in more detail in the following by means of the figures, along with the description of the preferred embodiment of the invention. The following is shown:

DETAILED DESCRIPTION OF THE ILLUSTRATIVE EMBODIMENTS

FIGS. 1 to 4 show an exemplary embodiment of a diagonal fan 1 according to example embodiments of the invention.

Figure 1:
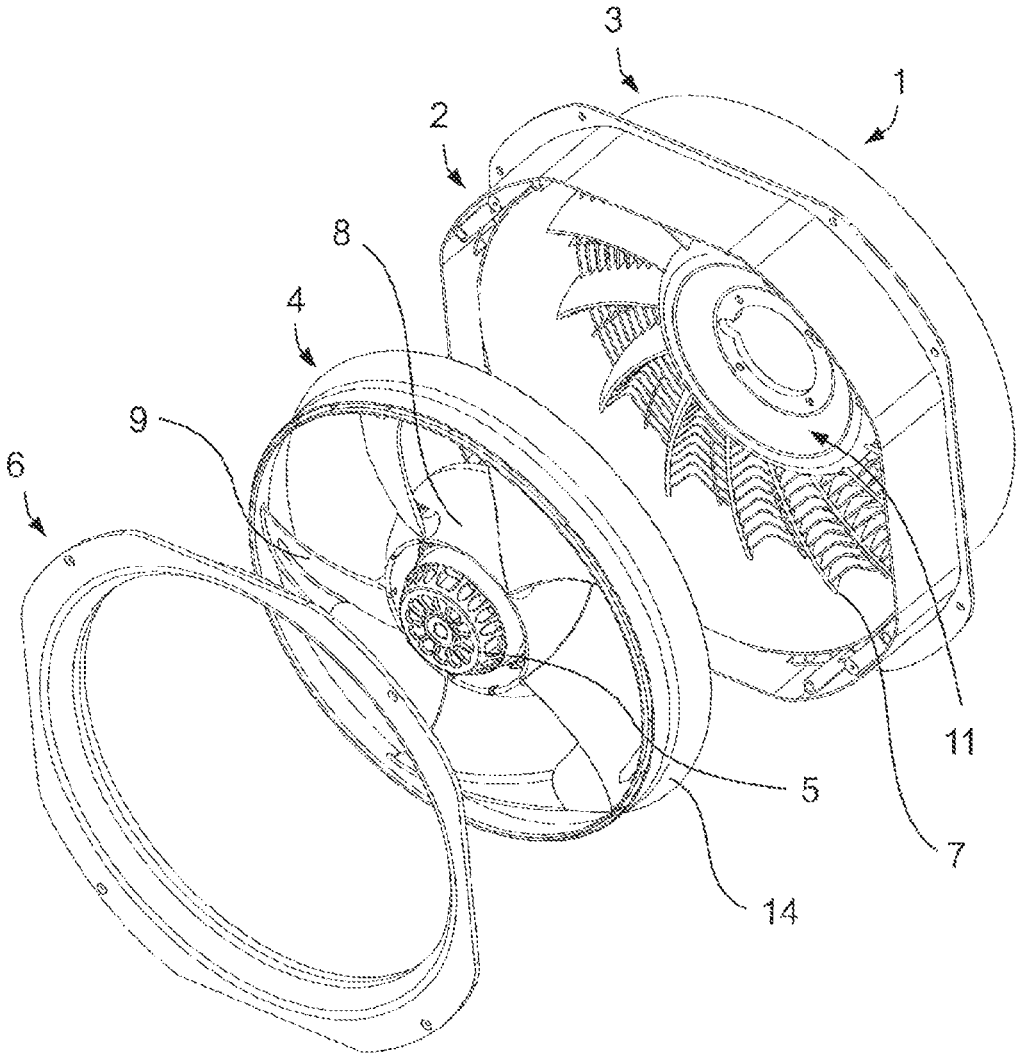
FIG. 1 a perspective exploded view of a diagonal fan with a view to the inlet side.
Figure 2:
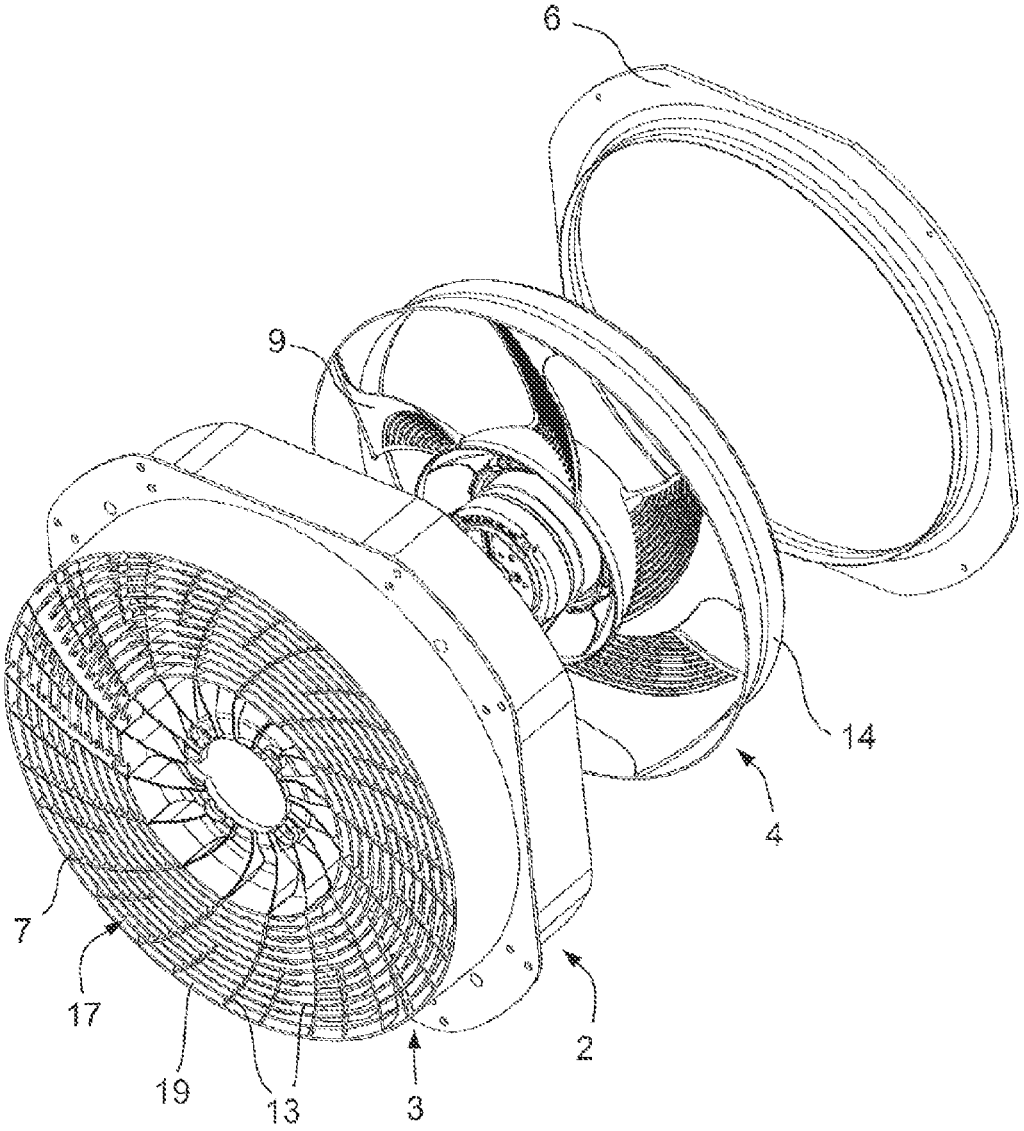
FIG. 2 a perspective exploded view of the diagonal fan from FIG. 1 with a view to the outlet side.

The exploded views according to FIGS. 1 and 2 show the components of the housing 2 with the outlet guide vane device 3 formed as a fixed component in a single part, of the diagonal impeller 4, of the electric motor 5 formed as an external rotor motor, and of the inlet nozzle 6 which can be inserted into the housing 2.

Figure 3:
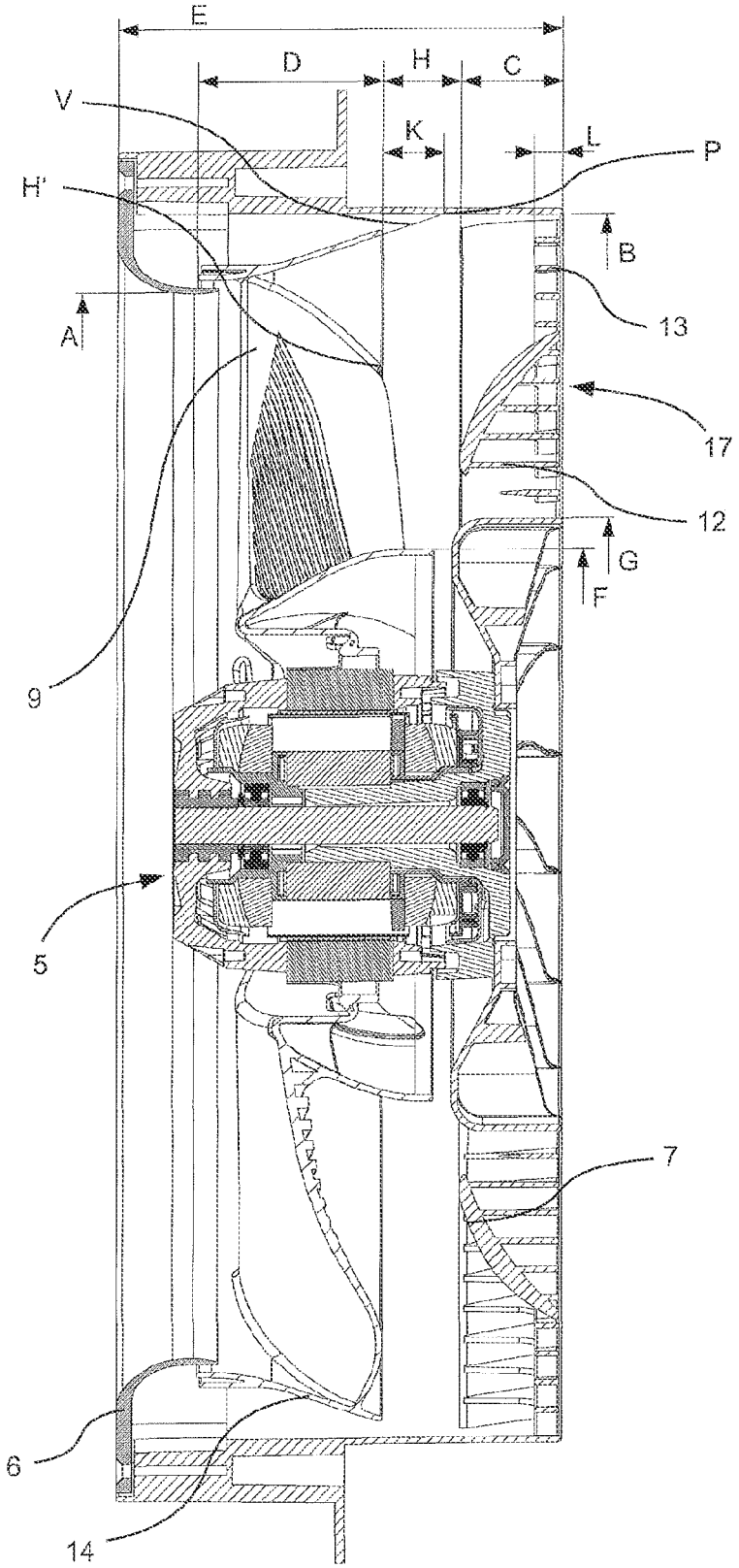
FIG. 3 a view in the radial section of the diagonal fan from FIG. 1.
Figure 4:
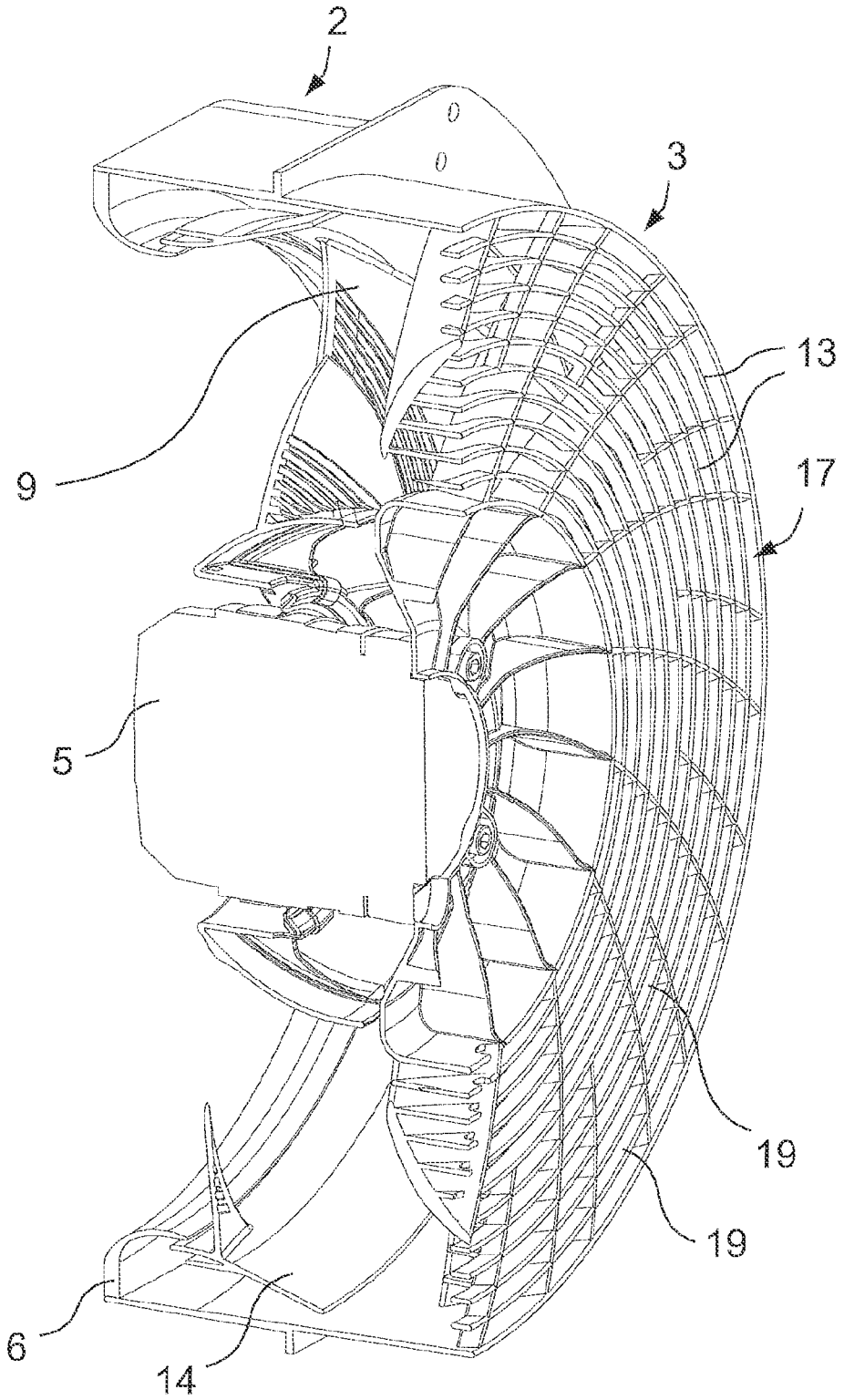
FIG. 4 a perspective sectional view of the diagonal fan from FIG. 1.

FIGS. 3 to 4 show the diagonal fan 1 in the mounted state and having a total axial length E. The diagonal impeller 4 comprises several impeller blades 9 extending from the axially open hub 8 outward radially, which are surrounded by the slinger ring 14. The slinger ring 14 has a flow cross-section which expands outward radially in the axial flow direction and is directed to the inner wall of the housing 2. The electric motor 5 is inserted into the axially open hub 8 of the diagonal impeller 4 and is thereby completely enclosed. In the axial direction, i.e. along the axis of rotation, the electric motor 5 extends into the axially central depression 11 such that it can be positioned closer to the diagonal impeller 4. The diagonal impeller 4, which is driven by the electric motor 5, is arranged within the housing 2 forming a flow channel and has an axial length D. The inlet nozzle 6 is arranged on the inlet side and extends into the region of the diagonal impeller 4 with its end section of the lowest flow diameter (diameter A) such that the slinger ring 14 and the end section of the inlet nozzle 6 overlap one another.

During operation, the diagonal fan 1 intakes air in the axial direction via the diagonal impeller 4 and conveys it diagonally, i.e. opposite the axis of rotation, at a predetermined outflow angle, in the direction of the inner wall of the housing 2. In the design shown, the outflow angle is essentially determined via the slinger ring 14. The imaginary extension V in the outflow angle of the diagonal impeller 4, determined by the slinger ring 14, strikes the inner wall of the housing 2 at point P at an axial distance K from the diagonal impeller 4. The axial plane at which the slinger ring 14 ends is used as the measuring point for distance K. In the designs without the slinger ring 14, the measurement takes place on the axial plane determined by the radial outer edge of the impeller blades 9, characterized by letter H'. The flow is subsequently deflected back into an axial flow direction at the inner wall of the housing 2 and conveyed to the outlet guide vane device 3.

As viewed in the axial flow direction, the outlet guide vane device 3 is arranged within distance H, after the diagonal impeller 4, with a plurality of guide vanes 7 distributed in the circumferential direction. The ratio between distances K/H is established at 0.8 in the design shown.

The outlet guide vane device 3 further comprises an integral protective grille 17 with a plurality of annular webs 13 arranged coaxially as relates to each other, each of which form web surfaces 19 which extend parallel to the axial flow direction and are opposite one another. The axial length L of the protective grille 17 corresponds to less than half the axial length C of the outlet guide vane device 3. The maximum flow diameter of the outlet guide vane device (diameter B) is in the range of the annular webs 13 on the outlet side. The outlet guide vane device 3 homogenizes the flow by means of the guide vanes 7 and the protective grille 17. The guide vanes 7 extend through the protective grille 13 in the axial direction and thus penetrate the annular webs 13 as a type of arc-shaped radial webs, as is clearly shown in FIG. 2.

FIG. 1 clearly shows that the annular webs 13 in the region of the guide vanes 7 are formed so as to protrude axially as relates to the leading edge of the respective guide vanes 7 in section 12 and thus ensure reinforcement and support of the guide vanes 7. The guide vanes 7 are curved, in the shape of an arc as viewed in the axial cross-section and radially outward in the radial section according to FIG. 3, such that a three-dimensional overall curvature results. In addition, the guide vanes 7 are profiled according to a supporting surface in the radial section according to FIG. 3, in which their respective thicknesses first enlarge and subsequently reduce again in the axial direction.

With reference to FIG. 3, the ratio is shown between the maximum diameter G of the hub region of the outlet guide vane device 3 and the maximum diameter F of the hub 8 of the diagonal impeller 4, where G>F.

According to example embodiments of the invention, a diagonal fan is proposed having an electric motor, a housing, and a diagonal impeller, which is accommodated within the housing and can be driven via the electric motor. The diagonal flow generated by the diagonal impeller during operation is deflected in an axial flow direction by an inner wall of the housing. An outlet guide vane device with a plurality of guide vanes, which are distributed in the circumferential direction, is arranged adjacently to the diagonal impeller when viewed in the axial flow direction, and the outlet guide vane device homogenizes an airflow generated by the diagonal impeller, in which the guide vanes have a radial extension from a hub region of the outlet guide vane device to the housing. The outlet guide vane device is arranged at a special axial distance from the diagonal impeller. To this end, a point is established at which an imaginary extension in the outflow angle of the diagonal impeller strikes the inner wall of the housing at an axial distance K from the diagonal impeller. The outlet guide vane device is arranged in a region about the point of intersection between the outflow angle and the inner wall of the housing at an axial distance H to the diagonal impeller, such that $0.75 \leq K/H \leq 1.25$. The outflow angle of the diagonal impeller is determined via the impeller blades or an optional additional slinger ring. The measuring point on the outlet guide vane device is the axial plane which is foremost as relates to the diagonal impeller, at which diagonal impeller the axial plane through the radial outer edges of the impeller blades or a slinger ring is used, the end of which is axial as relates to the outlet guide vane device.

The diagonal flow blown out by the diagonal impeller is deflected in an axial flow direction by the housing and homogenized by the outlet guide vane device. The special arrangement as relates to one another enables the long throw distance with a simultaneously compact axial construction.

An advantageous design for the diagonal fan provides that the outlet guide vane device is formed as a single part with the housing. The number of parts and the assembly steps can thus be reduced. In addition, a seal is no longer needed between the components.

In one refinement, the outlet guide vane device has a protective grille extending over a blow-out portion of the diagonal fan. The axial length L of the protective grille in this case is less than 50% of the maximum axial length C of the outlet guide vane device.

Further favorable is a design variant of the diagonal fan in which the outlet guide vane device, the housing, and the protective grille are formed as one piece.

In one advantageous design, the protective grille further has a plurality of annular webs arranged coaxially as relates to each other, each of which form web surfaces which extend parallel to the axial flow direction and are opposite one another. Thus, the flow is guided in parallel along the web surfaces over the entire axial length L of the protective grille.

In one refinement of the diagonal fan, the annular webs are formed to axially protrude in the region of the guide vanes as relates to a leading edge of the respective guide vanes. Thus, the guide vanes can partially be formed by the aforementioned section of the annular webs to the extent that the web surfaces formed by the annular webs in the region of the guide vanes are enlarged axially. In addition, the axially protruding sections of the annular webs can serve to reinforce the guide vanes.

The guide vanes of the outlet guide vane device may have different shapes and cross-sections. In one advantageous design, the guide vanes are curved in the shape of an arc and are additionally or alternatively profiled, as viewed in the axial cross-section. An airfoil shape, i.e. a convexly curved shape, can be determined, for example, as a profiled shape. Consequently, the different angles of inflow of the diagonal impeller respectively used can be considered. In this case, a straight-line radial extension of the guide vanes is also possible.

In addition to the design which is curved forward or backward as viewed in the axial cross-section, the guide vanes of the outlet guide vane device can be formed to curve three-dimensionally in a further alternative design, i.e. the curvature takes place in addition in the axial extension.

A favorable design of the diagonal fan additionally provides that the guide vanes of the outlet guide vane device merge directly into the protective grille and thus interact fluidically directly with each other.

In addition to the outlet guide vane device, the diagonal impeller also comprises a hub with impeller blades attached thereto or formed thereon. The two hubs or hub regions are preferably dimensioned such that a maximum diameter G of the hub region of the outlet guide vane device is greater than a maximum diameter F of a hub of the diagonal impeller such that the hub region of the outlet guide vane device covers the hub of the diagonal impeller, as viewed in an axial projection.

One solution of the diagonal fan which is advantageous for the axially compact design is characterized in that the outlet guide vane device has a motor mount for the electric motor in the hub region. To this end, the hub region of the outlet guide vane device can additionally be pulled in axially such that the motor components and the outlet guide vane device overlap, as viewed in the radial section.

As previously addressed, one advantageous design of the diagonal fan provides that the diagonal impeller has a slinger ring which encompasses the impeller blades distributed in the circumferential direction. The slinger ring enables a precisely adjustable outflow angle as well as flow guidance at a predetermined angle as relates to the axis of rotation of the diagonal impeller.

A further advantageous aspect with the diagonal fan is to form the electric motor as an external rotor motor. The diagonal impeller can thereby enclose the motor, and the axial space needed is minimized.

One refinement of the diagonal fan further provides that it comprises an inlet nozzle, which is arranged on the housing on the intake side. The inlet nozzle preferably extends into the slinger ring in the axial direction such that the inlet nozzle and the slinger ring overlap in sections, as viewed in the radial section.

The invention claimed is:

1. A diagonal fan comprising an electric motor, a housing, and a diagonal impeller having impeller blades, which is accommodated within the housing and driven via the electric motor, the diagonal flow thereof generated during operation being deflected in an axial flow direction by an inner wall of the housing, wherein an outlet guide vane device with a plurality of guide vanes, which are distributed in the circumferential direction, is arranged adjacently to the diagonal impeller in the axial flow direction, the outlet guide vane device homogenizing an airflow generated by the diagonal impeller, wherein the guide vanes have a radial extension from a hub region of the outlet guide vane device to the housing, wherein the diagonal impeller has a slinger ring that encloses the impeller blades distributed in the circumferential direction and has a flow cross-section that expands outward radially in the axial flow direction and is directed to the inner wall of the housing to establish an outflow angle of the diagonal impeller such that the airflow from the diagonal impeller strikes the inner wall of the housing at a point P at an axial distance K measured from an axial plane at which the slinger ring ends and which is located at a radial outer edge of one of the diagonal impeller blades along an axial plane of the diagonal fan such that the diagonal impeller blades are enclosed within the slinger ring, and the outlet guide vane device is arranged at an axial distance H measured from the axial plane at which the slinger ring ends such that $0.75 \leq K/H \leq 1.25$ so that the airflow is deflected into an axial flow direction at the inner wall of the housing and conveyed to the outlet guide vane device, wherein the outlet guide vane device has a protective grille extending over a blow-out portion of the diagonal fan, wherein the outlet guide vane device and the protective grille are integral and formed as a single part with the housing, wherein the guide vanes of the outlet guide vane device, and the impeller blades, are both curved in an axial cross-section thereof in a shape of an arc but in opposite circumferential directions with respect to each other, wherein the protective grille has a plurality of annular webs arranged coaxially as relates to each other, each of the plurality of annular webs forming web surfaces that extend parallel to the axial flow direction and are opposite one another, and the plurality of annular webs extending from corresponding positions along a radial length of each of the guide vanes, and wherein each of the plurality of annular webs is formed to protrude axially along a leading edge of the respective guide vanes.

2. The diagonal fan according to claim 1, characterized in that the protective grille has an axial length L, which is less than an axial length C of the outlet guide vane device, where $L<0.5 \times C$.

3. The diagonal fan according to claim 1, characterized in that the guide vanes of the outlet guide vane device are curved in the shape of an arc and/or are profiled in the axial cross-section.

4. The diagonal fan according to claim 1, characterized in that the guide vanes of the outlet guide vane device are formed to curve three-dimensionally.

5. The diagonal fan according to claim 1, characterized in that the guide vanes of the outlet guide vane device directly merge into the protective grille.

6. The diagonal fan according to claim 1, characterized in that a maximum diameter G of the hub region of the outlet guide vane device is greater than a maximum diameter F of a hub of the diagonal impeller such that the hub region of the outlet guide vane device covers the hub of the diagonal impeller, as viewed in an axial projection.

7. The diagonal fan according to claim 1, characterized in that the outlet guide vane device has a motor mount for the electric motor in the hub region.

8. The diagonal fan according to claim 1, characterized in that the electric motor is formed as an external rotor motor.

9. The diagonal fan according to claim 1, characterized in that it comprises an inlet nozzle, which is arranged on the housing on the intake side, and wherein the inlet nozzle extends into the slinger ring in the axial direction.

10. The diagonal fan according to claim 1, characterized in that the guide vanes extend through the protective grille in the axial direction and penetrate the annular webs as arc-shaped radial webs.

11. The diagonal fan according to claim 9, characterized in that the inlet nozzle extends into the region of the diagonal impeller with an end section of smallest flow diameter, the slinger ring and an end section of the inlet nozzle overlapping one another.

* * * * *